US005787749A

United States Patent [19]

Reismann et al.

[11] Patent Number: 5,787,749

[45] Date of Patent: Aug. 4, 1998

[54] ROLLING MILL STAND

[75] Inventors: Hans-Jürgen Reismann, Düsseldorf; Konrad Hamraths, Kaarst, both of Germany

[73] Assignee: SMS Schloemann Siemag AG, Dusseldorf, Germany

[21] Appl. No.: 137,868

[22] Filed: Oct. 15, 1993

[30] Foreign Application Priority Data

Oct. 15, 1992 [DE] Germany ..... 42 34 732.7

[51] Int. Cl.[6] ..... B21B 13/10

[52] U.S. Cl. ..... 72/225; 72/239

[58] Field of Search ..... 72/225, 238, 239

[56] References Cited

U.S. PATENT DOCUMENTS

| | | | |
|---|---|---|---|
| 4,557,130 | 12/1985 | Bond | 72/225 |
| 4,905,493 | 3/1990 | Benedetti | 72/225 |
| 4,907,437 | 3/1990 | Poloni et al. | 72/225 |
| 4,974,438 | 12/1990 | Stubbins | 72/238 |

FOREIGN PATENT DOCUMENTS

| | | | |
|---|---|---|---|
| 54-139866 | 10/1979 | Japan | 72/225 |
| 2034222 | 6/1980 | United Kingdom | 72/239 |

*Primary Examiner*—John Sipos

*Attorney, Agent, or Firm*—Anderson, Kill & Olick, P.C.

[57] ABSTRACT

A universal rolling mill stand includes a drive side roll mount, an operator's side roll mount extending parallel to the drive side roll mount and adapted to move away therefrom, and an alternate frame, in which horizontal and vertical rolls are mounted and which is movable together with the operator's side roll mount.

5 Claims, 5 Drawing Sheets

ROLLING MILL STAND

BACKGROUND OF THE INVENTION

The invention is directed to a rolling mill stand with adjustably supported rolls and two roll mounts extending parallel to one another, of which the roll mount next to the operator can be moved away from the other roll mount. Especially, the invention relates to a universal roll stand with horizontal rolls and vertical rolls disposed in adapters.

The most different profiles, for instance, twin T and U-beams or rails, can be rolled on universal roll stands operating in continuous or reversing operation. The horizontal-and vertical sets of rolls of known stands are disposed in installation pieces in window recesses of the mounting posts, wherein the installation pieces of the horizontal rolls abut in pairs against upper and lower transverse beams, which are retained by thrust routs engaging into pairs of screwed-down spindles facing each other on both sides of the rolling line from axial displacement but with the possibility of rotation.

In order to avoid lifting of the transverse yokes off the remaining roll stand parts when replacing rolls, the upper transverse yoke is divided into two parts in a universal stand construction known from the DE-30 39 203 C2, so that the transverse yoke can be swiveled outwardly and back inwardly after the rolls have been replaced and can be clamped to the remaining stand part. The installation pieces receiving the rolls are freely accessible in the outwardly swiveled position and can be removed, through the window recesses, from the stand. In order to achieve the swiveling, including the outward swiveling, additional swiveling mechanisms, for instance, in the form of hydraulic swiveling cylinders are required, apart from the installation pieces which provide for effective possible reasonable replacement of rolls.

The replacement of rolls can be simplified compared to the above, by mounting of the horizontal rolls in bearings disposed in the roll mounts without the use of installation pieces, with the operator's side roll mount, with the bearings facing away from the drive elements being movable away in the rolling axial direction of the horizontal rolls from the other roll mount and with the vertical rolls supported in adapters being slid into guides rigidly connected with the roll mounts after the displacement of the operator's side roll mount such that not only the horizontal, but also the vertical rolls are freely accessible and can be accessed from the inside of the pulled-apart roll mounts. The adapters supporting the vertical rolls can thus be brought directly into the installation position in the roll mounts required for rolling operations, namely, by sliding into the guide, so that installation pieces are no longer required.

It is therefore an object of the invention further to simplify roll replacement in a rolling mill stand of this type, especially a universal rolling mill stand and to reduce the down time of the rolling mill train when replacing rolls.

SUMMARY OF THE INVENTION

This and other objects of the invention, which shall become hereafter apparent, are achieved by providing an alternate frame which receives the rolls and can be moved away from the roll mount on the operator's side. In a two-high rolling mill stand, these are the vertically or horizontally disposed rolls, and in a universal roll stand, these are the horizontal as well as the vertical rolls. After having moved the operator's side roll mount away, to which the alternate frame is locked, for which purpose the alternate frame comprises preferably snap-in recesses for locking lugs of the roll mount on the operator's side which can be moved in and out of the snap-in recesses, the alternate frame which is configured at the same time as an equipment support, according to one embodiment of the invention, can be replaced in its entirety, which assumes prior unlocking.

Due to the displacement of the roll mount on the operator's side into its end position, the alternate frame, with the rolls or the roll rings, finds itself in an intermediate position, for instance, on the foundation or on rails, being completely free. It is thus accessible for a crane or a manipulating platform, by means of which the alternate frame, containing all the parts subject to wear (vertical and horizontal rolls as well as equipment for profile depending parts), can be removed from the rolling mill train. The disassembly of the set of rolls no longer needs to be accomplished in the rolling mill train. Rather, it can be performed in the rebuilding shop without interfering with the ensuing operation of the rolling train.

Principally, with small lot sizes, a very simple, rapid replacement of rolls can be achieved than otherwise possible with only replacement stands which also require several stands to be kept in reserve, resulting in increased expenditure.

According to a preferred embodiment of the invention it is proposed that the alternate frame be provided with stacker plates for instance, steel plate structures supporting the roll collars of the top and bottom horizontal rolls. When exchanging rolls, the screw-down adjusting devices are opened up to a maximum so that an adequate exposed space is provided, which permits to swivel the plates, designed preferably as swiveling levers, for the horizontal roll into position, supporting the roll collar from the bottom. Any type of swiveling drive is suitable for swiveling the levers, for instance, hydraulic cylinders pivotally connected with the swiveling levers. In the course of the rolling operation, the swiveling levers assume position out of operation, removed from the roll collar, whose diameter remains constant since it is not exposed to any wear and used for support when replacing rollers. Since the stacker plates for the lower horizontal roll must not interfere with the rolling operation, they can be rigidly connected with the alternate frame, for instance, they can be designed as stop rests or supports.

According to another embodiment of the invention the alternate frame is provided with projections for receiving adapters which extend into the roll stand in the region of the vertical rolls. The adapters thus are located at the point of the action are slid into the projections forming an integral component of the alternate frame.

BRIEF DESCRIPTION OF THE DRAWINGS

Other features and advantages of the invention will become more apparent from the following Detailed Description of the Preferred Embodiments with reference to the accompanying drawings, wherein.

DETAILED DESCRIPTION OF THE PREFERRED EMBODIMENTS

Figure 1:
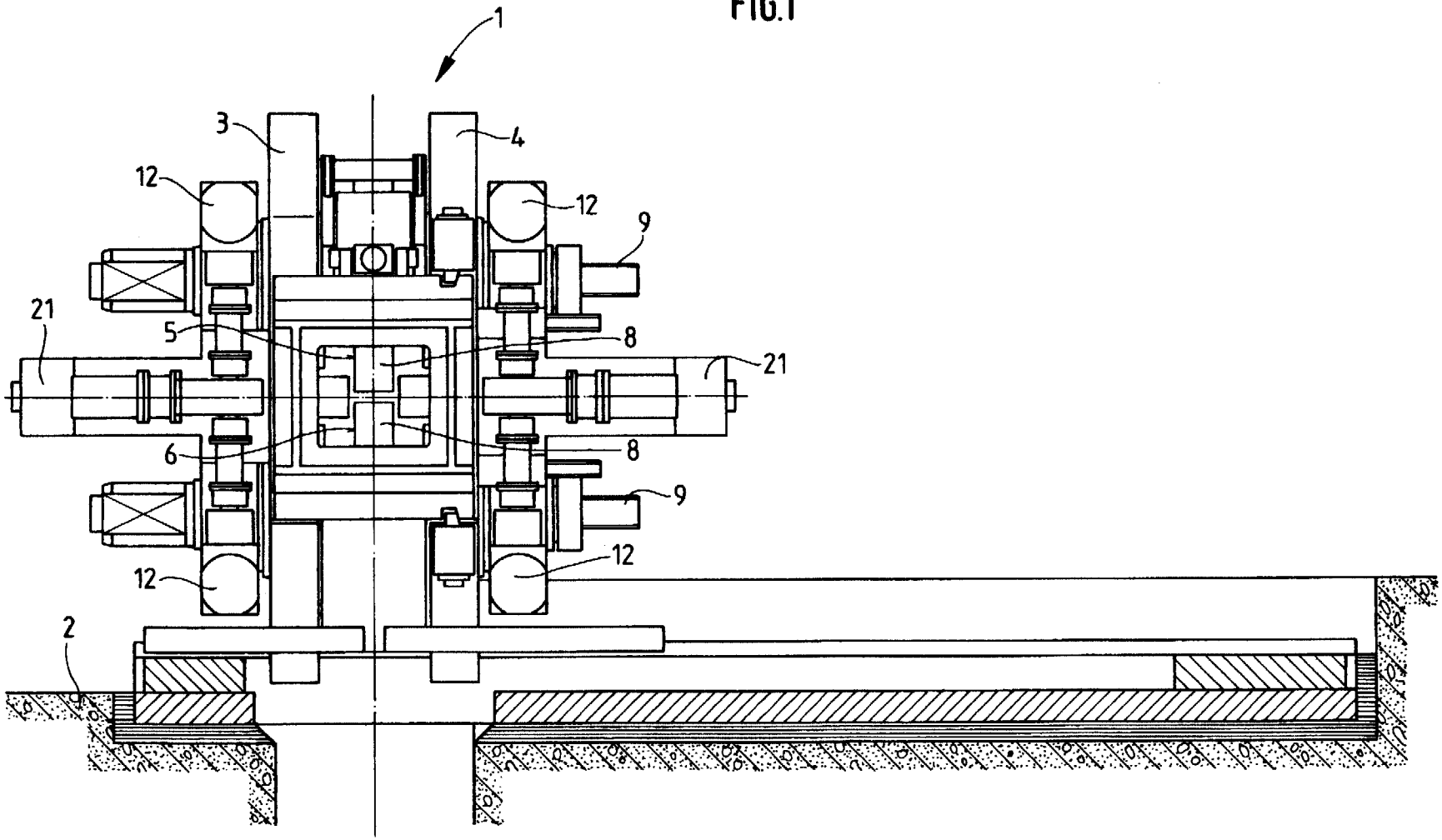
FIG. 1 is a front view of a universal rolling mill stand with an alternate frame according to the invention.
Figure 2:
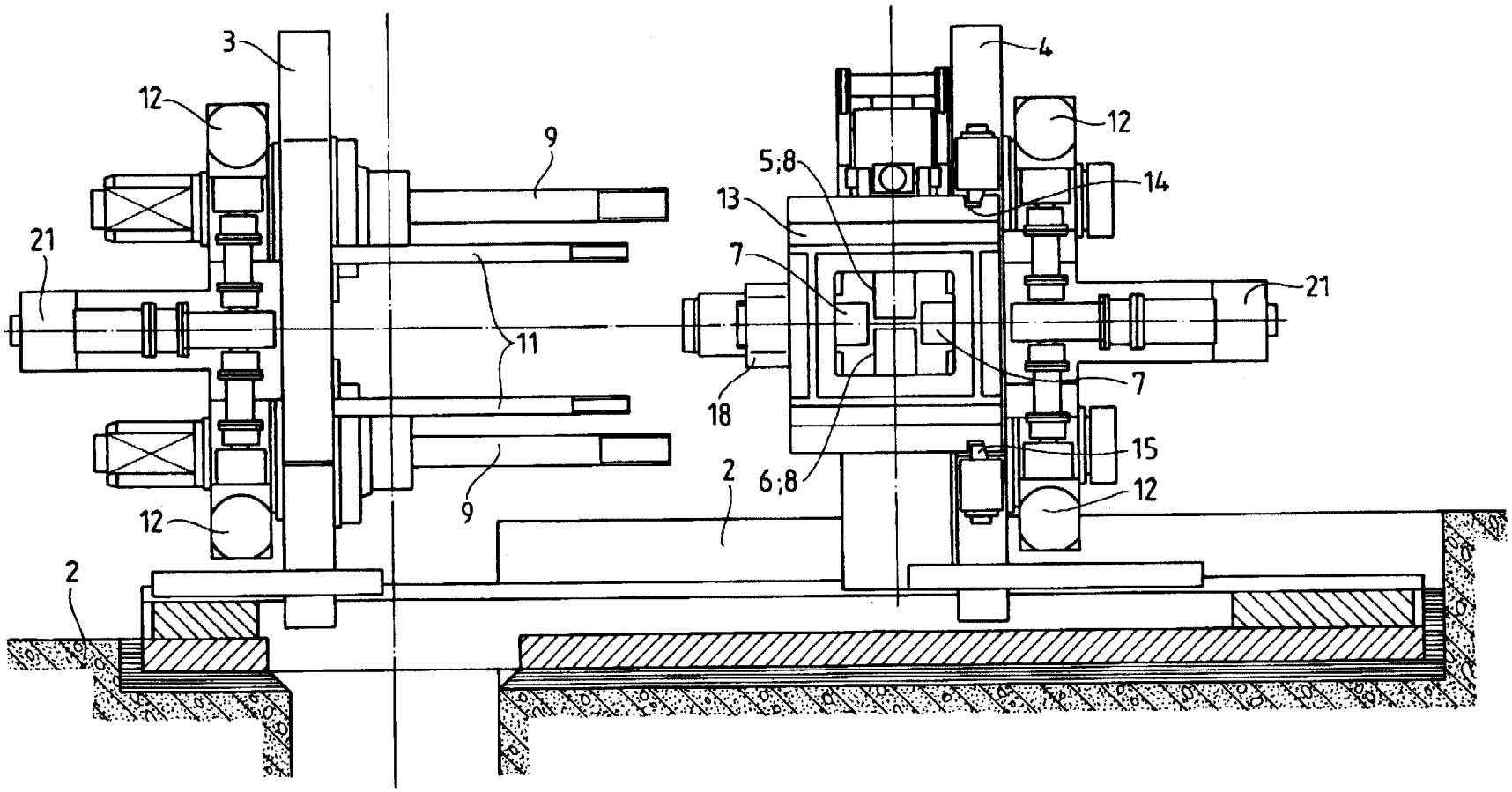
FIG. 2 is a view similar to that of FIG. 1, with a roll mount on the operator's side including the alternate frame moved into an intermediate position.
Figure 3:
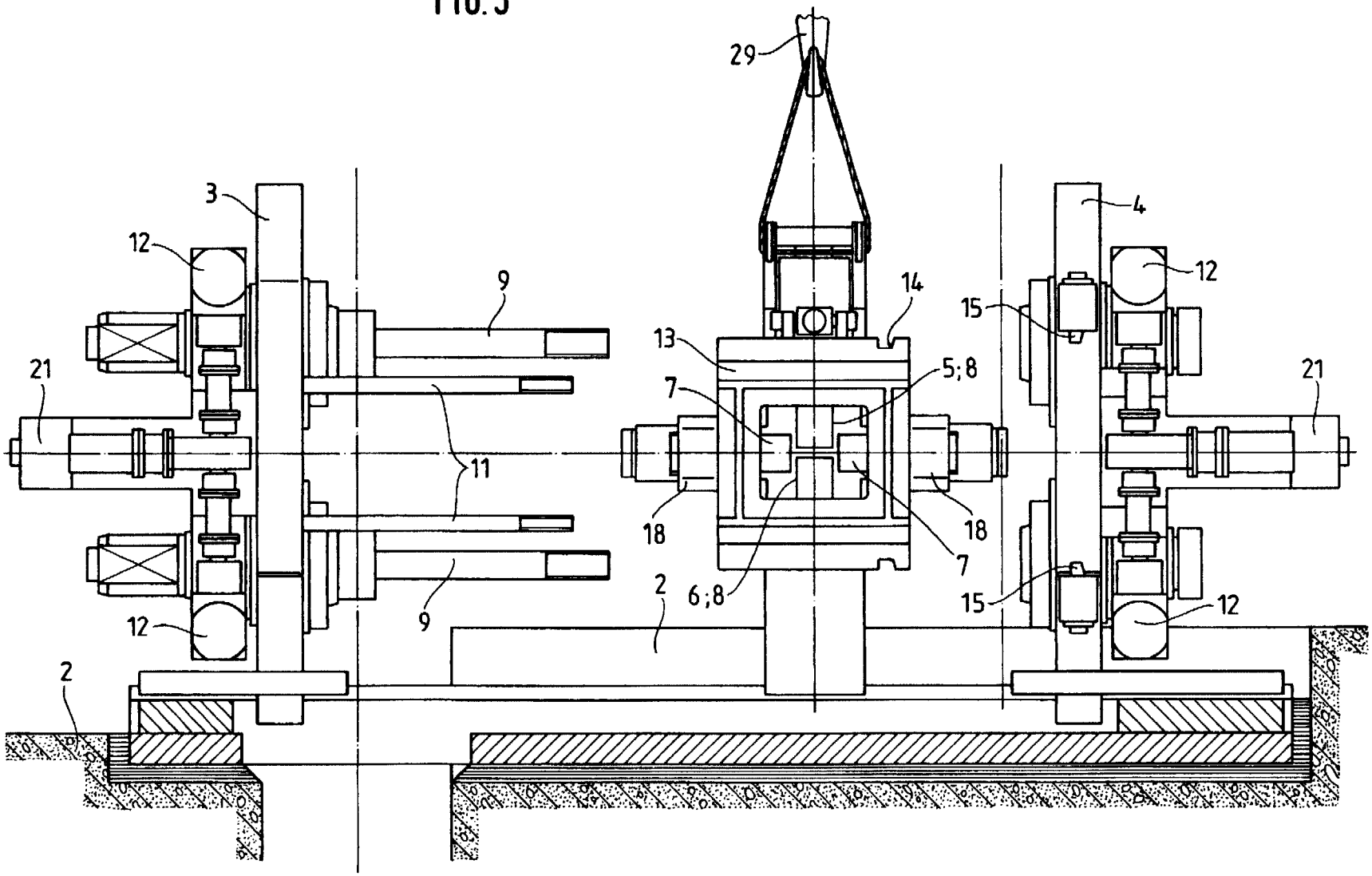
FIG. 3 is a view similar to that of FIG. 1, with the roll mount stand on the operator's side moved into its end position and an alternate frame part in an intermediate position.

Referring now to the drawings, wherein like numerals reflect like elements throughout the various views, FIGS. 2 and 3 depict the universal rolling mill stand 1 shown in FIG. 1, as including roll mount 3, which is connected on the drive side, to the foundation 2 by means of a bearing plate and a mobile roll mount 4 on the operator's side. The roll mounts 3, 4 extend parallel to one another and a displacement cylinder (not shown) can engage, with its piston rod, the roll mount 4 on the operator's side for displacing the same. The position of the roll mount 4 on the operator's side, moved away from the roll mount 3, is shown in FIG. 2 in an intermediate position and in FIG. 3 in the end position. Top and bottom horizontal rolls 5, 6, as well as two vertical rolls 7 are deposed without the use of additional installation pieces in the roll mounts 3, 4.

The horizontal rolls 5, 6 are of multipart design. They comprise two support shafts, of which one is supported in the drive side roll mount 3 and the other in the operator's side roll mount 4. They enclose, between themselves, a roll ring and are clamped to each other by a tie rod 9 to form one unit. Furthermore, four thinner tie rods 11 are present which clamp the two roll mounts 3, 4 to each other. For adjusting the horizontal rolls 5, 6 or the roll rings 8, screwed-on mechanisms 12 are used to move the horizontal rolls 5, 6, in accordance with the rotational direction of the drives 12, either away from or closer to one another.

Figure 4:
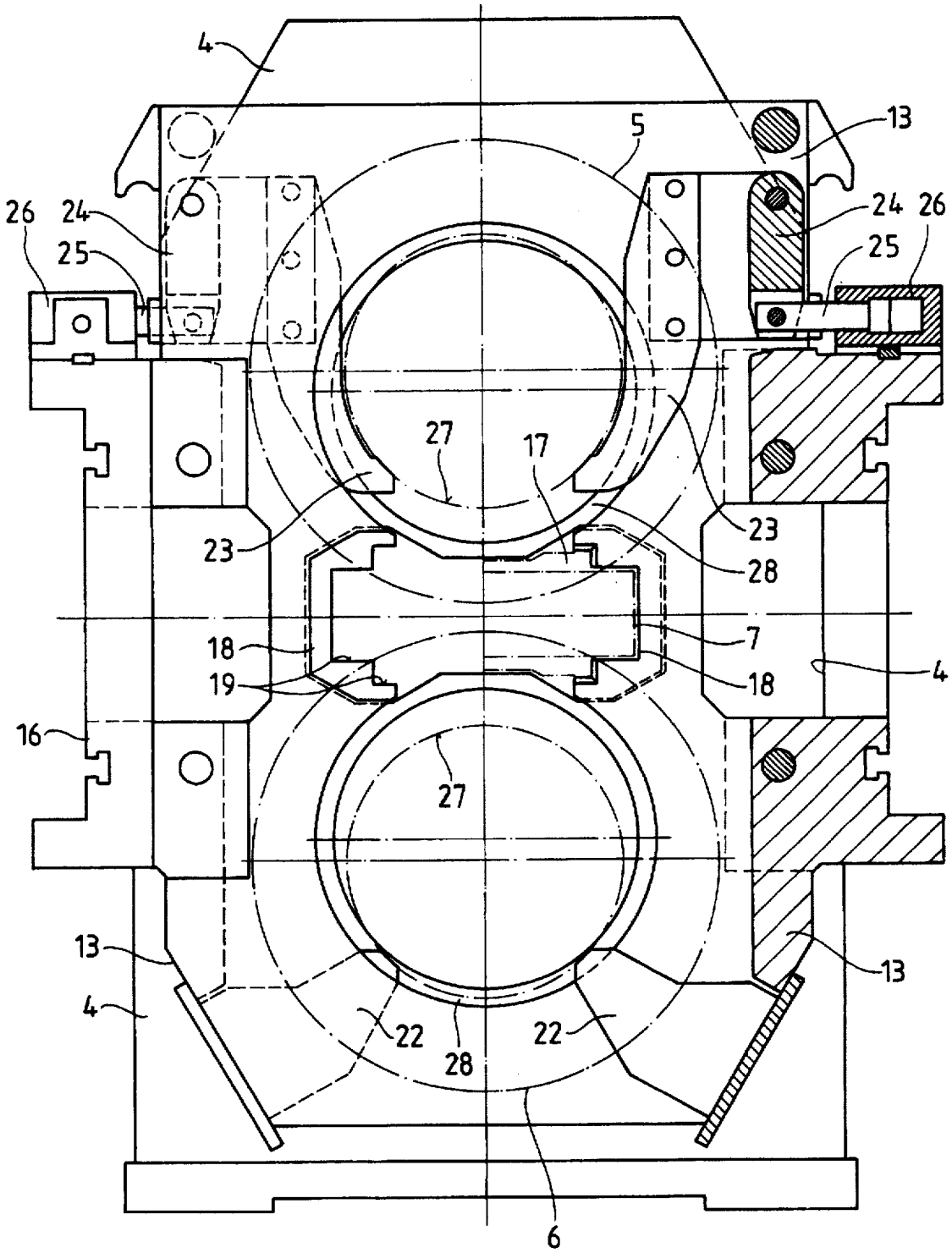
FIG. 4 is an enlarged schematic side view of a rolling mill stand with the alternate frame integrated therein.
Figure 5:
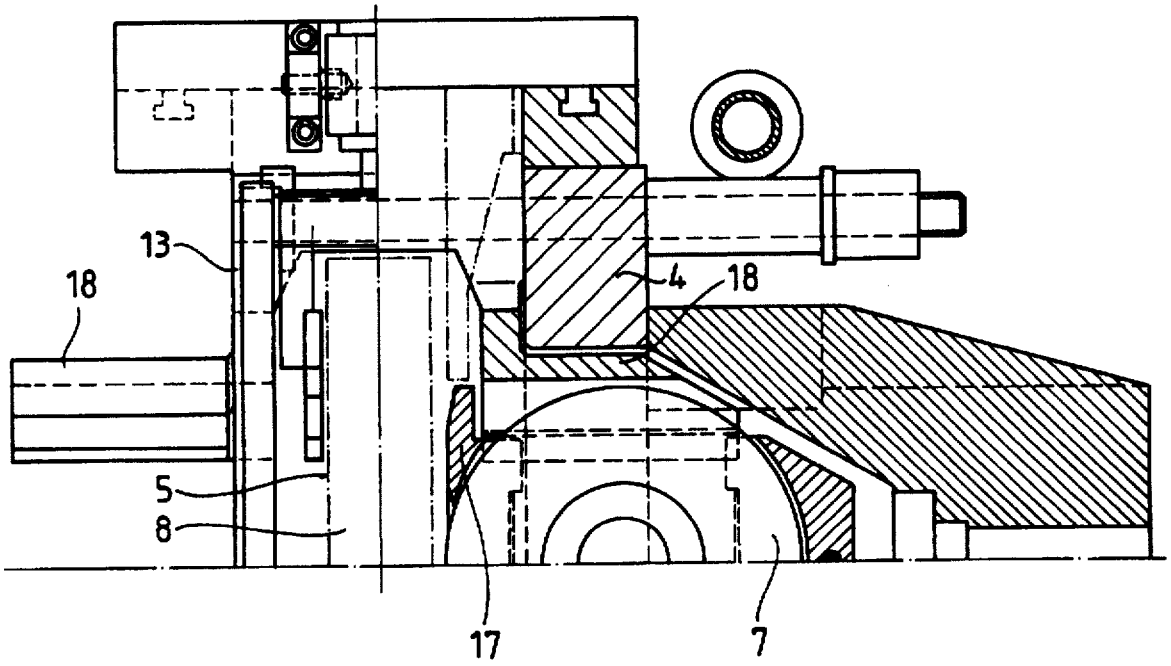
FIG. 5 is a partial cross-sectional plan view of the universal rolling mill stand shown in FIG. 1.

The horizontal rolls 5, 6 and their roll rings 8, as well as the vertical rolls 7 are disposed in an alternate frame 13, which is locked hydraulically to the mobile roll mount 4 on the operator side. It has snap-in recesses 14 (see FIG. 3) for this purpose, into which locking lugs 15 attached to the roll mount 4 can snap in. Furthermore, the alternate frame 13 is provided with an equipment support 16 (see FIG. 4) which receives the equipment necessary for operating the roll stand 1. The vertical rolls 7 are respectively located in an adapter 17 (see FIG. 4) which are arranged in a projections 18, projecting into the roll mounts 3 and 4. In FIG. 4, the guides of the projections 18 extend, in the direction of the drawing plane, into the windows of the roll mount 3. In the operating state of the universal rolls stand 1, shown in FIG. 1, the vertical rolls 7 are connected to roll adjusting mechanisms 21.

In addition, the alternate frame 13 is provided, on the one hand, with stationary stacker plates 22 associated with the bottom horizontal roll 6 and, on the other hand, with stacker plates designed as swiveling levers 23 associated with the top horizontal roll 5. Each swivel lever 23 is connected by an intermediate lever 24 to the piston rod 25 of a hydraulic adjustment cylinder 26 (see FIG. 4). The horizontal rolls 5, 6 are carried in eccentric sleeves 28 connected to the horizontal roll adjustment with screwed-on mechanism 12.

In order to exchange rolls, the adjusting mechanisms of the horizontal rolls 5, 6 are moved away from each other as far as possible. The bottom horizontal roll 6 then abuts with roll collar 27, the bottom stacker plates 22 and the top horizontal roll 5 abuts, with its roll collar, the swiveling lever 23 swiveled out of its non-operational position into the removal position shown in FIG. 4. After detachment of the horizontal rolls 5, 6 and the tie rods 11 and 9, which clamp the two roll mounts 3, 4 to one another, the mobile roll mount 4 on the operator's side is moved away from the roll mount 3 from the position shown in FIG. 1, into the intermediate position shown in FIG. 2. The locking lugs 15 are pulled out of snap-in recesses 14 in the alternate frame 3 in the intermediate position of the roll mount 4 and, when the roll stand 3 is displaced further into the end position shown in FIG. 3, the entire parts subject to wear, in particular the horizontal rolls 5, 6, the vertical rolls 7, as well as the alternate frame 13 containing the equipment remain in their intermediate position in which it rests upon the foundation 2 clamped, for instance, hydraulically thereto (not shown here). As shown in FIG. 3 the alternate frame 13 can be removed from the rolling mill train by a hoist 29 and can be immediately replaced by a newly assembled alternate frame.

The disassembly of the set rolls thus no longer occurs while they are still in the rolling mill train, rather in the remote rebuilding shop, which enables a rapid replacement of rolls, without unnecessary retarding rolling operation . The mounting of the a new alternate frame is subsequently performed in the reverse sequence of the enumerated steps.

What is claimed is:

1. A universal rolling mill stand, comprising:

a drive side roll mount;

an operator's side roll mount extending parallel to the drive side roll mount and adapted to move away therefrom; and an alternate frame, in which horizontal and vertical rolls are mounted and which is removably locked to the operator's side roll mount for joint movement therewith and for disengagement therefrom, wherein the alternate frame includes projections which support an adapter and extend in the region of the vertical rolls into the roll mounts.

2. A rolling mill stand according to claim 1, wherein the alternate frame is provided with an equipment support.

3. A rolling mill stand according to claim 1, wherein the alternate frame includes stacking plates for supporting roll collars of upper and lower horizontal rolls.

4. A rolling mill stand according to claim 3, wherein the stacking plates of the upper horizontal roll are configured as swiveling levers.

5. A rolling mill stand according to claim 1, wherein the alternate frame comprises snap-in recesses for receiving locking plugs of the operator's side roll mount.

* * * * *